United States Patent [19]

Roccaforte

[11] 4,341,341

[45] * Jul. 27, 1982

[54] TAKE OUT CARTON AND BLANK FOR FORMING SAME

[75] Inventor: Harry I. Roccaforte, Western Springs, Ill.

[73] Assignee: Champion International Corporation, Stamford, Conn.

[ * ] Notice: The portion of the term of this patent subsequent to Dec. 29, 1998, has been disclaimed.

[21] Appl. No.: 273,960

[22] Filed: Jun. 15, 1981

Related U.S. Application Data

[63] Continuation-in-part of Ser. No. 178,099, Aug. 14, 1980, Pat. No. 4,307,834.

[51] Int. Cl.[3] ..... B65D 5/10

[52] U.S. Cl. ..... 229/39 R; 229/45 R

[58] Field of Search ..... 229/39 R, 45 R, 52 B

[56] References Cited

U.S. PATENT DOCUMENTS 4,201,331 5/1980 Austin .
4,230,261 10/1980 Austin .
4,307,834 12/1981 Roccaforte .

FOREIGN PATENT DOCUMENTS 91734 3/1938 Sweden ..... 229/39 R

*Primary Examiner*—Herbert F. Ross
*Attorney, Agent, or Firm*—Evelyn M. Sommer

[57] ABSTRACT

A take out carton and a blank for forming the same is disclosed having a flat top portion and unique locking closure which provides additional stability for the carton. More particularly, a carton is disclosed having a tubular side wall and an auto-erecting lock bottom. The subject carton further includes a pair of opposed top panels, each having a pair of tab receiving apertures disposed adjacent the side edges thereof. A pair of opposed closure panels are provided each including two triangles. Each triangle further includes a central fold line defining a pair of minor triangular portions. The carton may have a generally inverted truncated pyramidal configuration to permit stacked nesting of the plurality of cartons. In the closed condition of the carton, the top edges of the top panels are in abutting relationship to define the flat top configuration. Each triangle of the closure panels is folded about its central fold line to define a double-ply closure tab which is rotatable into coplanar relationship with the top panel. A portion of each closure tab is interengaged with a tab receiving aperture in a top panel to secure the carton in the closed position. The cooperation between the closure tabs and the tab receiving apertures in the top panel functions to provide increased stability for the carton and inhibits the relative shifting between the top panels thereof.

12 Claims, 5 Drawing Figures

TAKE OUT CARTON AND BLANK FOR FORMING SAME

BACKGROUND OF THE INVENTION

This application is a continuation-in-part of U.S. Pat. application Ser. No. 178,099, filed Aug. 14, 1980, now U.S. Pat. No. 4,307,834.

The subject invention relates to a new and improved take out carton and a blank for forming the same having a sturdy and attractive reclosable flat top portion. The take out carton of the subject invention is formed from a planar sheet of cardboard blank and includes an auto-erecting lock bottom enabling the carton to be shipped from the manufacturer in a flattened condition. The carton may have straight sides or a generally inverted truncated pyramidal configuration to permit the stacked nesting of a plurality of cartons. In accordance with the subject invention, the top portion includes a unique closure structure including foldable closure tabs which may be interengaged with apertures provided in the top panels, the closure structure being suitable for rapid locking and closure, and to obtain a secure and stable carton.

Various cartons in the prior art have been developed for use at carry out food establishments which can be shipped in a flattened configuration and partially erected and stacked prior to being filled. After being filled, the cartons can be quickly closed enabling the consumer to carry out their purchase. One example of a prior art reclosable gabled top carton can be found in U.S. application Ser. No. 030,009, to Austin, filed Apr. 16, 1979, now U.S. Pat. No. 4,230,261, issued Oct. 28, 1980, and assigned to the same assignee as the subject invention. In the latter mentioned patent, a gabled top carton is disclosed which includes a pair of locking side panels having apertures formed therein. A pair of locking top panels, formed of three hingedly connected triangular sections, are also provided, each of which are foldable downwardly to form a locking tab which can be interengaged with the associated locking aperture in the side panel. In one embodiment of the prior art carton, a pair of bendable tabs are hingedly connected to the handle panels adjacent the gripping apertures formed therein. The bendable tabs inhibit the lateral shifting of the gabled top panels thereby increasing the structural rigidity of the carton and provide a more secure closure thereof.

It is an object of the subject invention to provide a new and improved take out carton having a unique closure means which provides increased structural stability for the carton.

It is a further object of the subject invention to provide a new and improved take out carton which includes a pair of closure panels which may be folded into interengagement with tab receiving apertures provided in the top portion of the carton such that the relative lateral shifting of the top panels is inhibited.

It is another object of the subject invention to provide a new and improved take out carton having a pair of unique closure panels formed of two triangles at each end of the carton. Each of the triangles being divided into two minor triangle portions each of which are foldable to define a closure tab. Each closure tab is capable of interengagement with a tab receiving aperture in a top panel of the carton thereby inhibiting lateral shifting of the top panels and providing increased structural stability of the carton.

SUMMARY OF THE INVENTION

In accordance with these and many other objects, the take out carton of the subject invention is formed from a single planar sheet of paperboard and includes a generally tubular side wall having opposed side and end panels. A bottom panel is hingedly connected to the bottom edges of the tubular side wall and includes four panels which are auto-erecting in configuration. Two top panels are respectively hingedly connected to the top edges of the opposed side panels and cooperate to define the flat roof portion of the carton. Each top panel includes an opposed pair of tab receiving apertures respectively disposed at the opposed side edges thereof, and form a part of the unique closure means.

In accordance with the subject invention, a pair of closure panels are provided which are respectively hingedly connected to the top edges of the opposed end panels. Each closure panel includes two triangular sections. Each triangle further includes a central fold line which effectively divides the triangle into two minor triangle portions. The side, end, top and closure panels may be tapered from the top edges to the bottom edges thereof, providing the carton with a generally inverted truncated pyramidal configuration. This configuration permits the stacked nesting of a plurality of open, empty cartons thereby conserving space.

In accordance with the subject invention, each side triangle of the closure panels is foldable to form a closure tab which is engageable with the apertures provided in the top panels for increasing the stability of the carton by reducing the tendency of the top panels to shift. More specifically, during the closure of the carton, the top edges of the top panels are rotated into abutting relationship thereby defining the flat top portion of the carton. As the top panels are closed, the minor triangle portions of each triangle of the closure tabs are rotated about the central fold line into an overlapping two-ply configuration defining the closure tab. Each closure tab is rotated into coplanar relationship with the adjacent top panel, and then manipulated such that a portion thereof becomes interengaged with a tab receiving aperture provided in the top panel. Preferably, each tab receiving aperture includes a pair of bendable holding flaps formed by a slit to permit the temporary enlargement of the aperture and thereafter to function as a locking mechanism for maintaining the interengagement of the tabs. The unique closure means inhibits the relative lateral shifting of the top panels thereby increasing the stability of the carton. By disengaging the closure tabs from the associated apertures the carton may be opened to gain access to the contents therein.

Further objects and advantages of the subject invention will become apparent from the following detailed description taken in conjunction with the drawings in which:

DESCRIPTION OF THE PREFERRED EMBODIMENT

Figure 2:
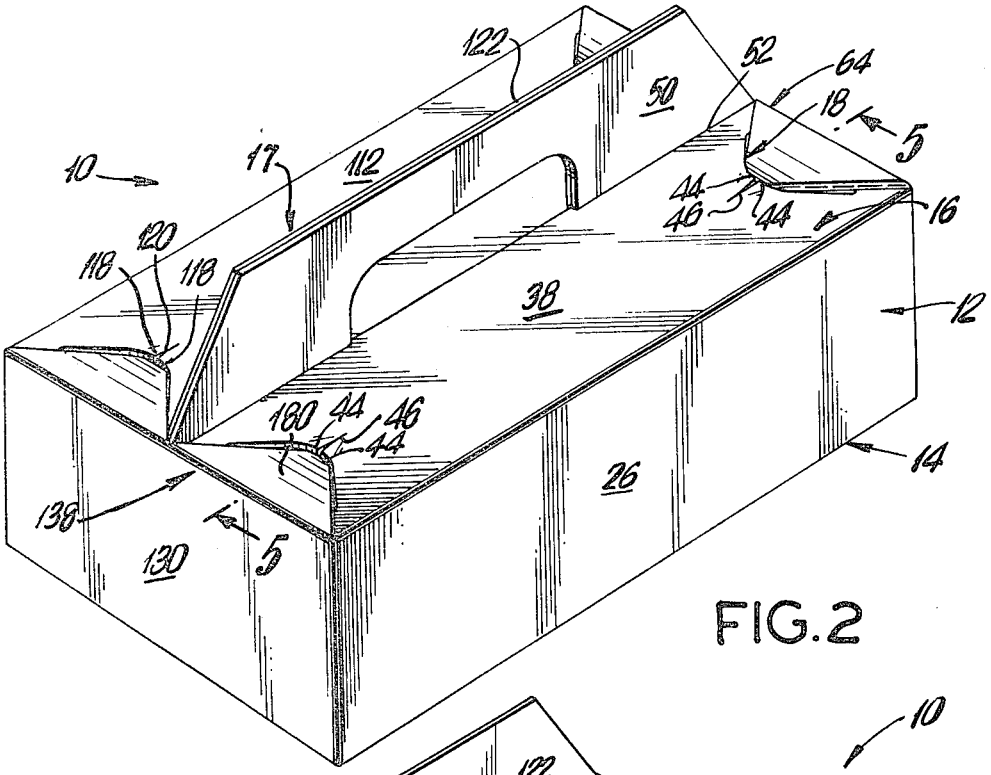
FIG. 2 is a perspective view of the new and improved carton of the subject invention illustrating the closed configuration thereof.

Referring to FIG. 2, the take out carton 10 of the subject invention is illustrated and includes an upstanding tubular side wall 12 hingedly connected to an auto-erecting lock bottom 14. The carton 10 includes a flat top portion 16 with a handle structure 17 extending upwardly therefrom. The carton is provided with a new and improved closure means 18 which inhibits the relative lateral shifting of the top panels thereby increasing the structural stability of the carton, as more fully described hereinafter.

Figure 1:
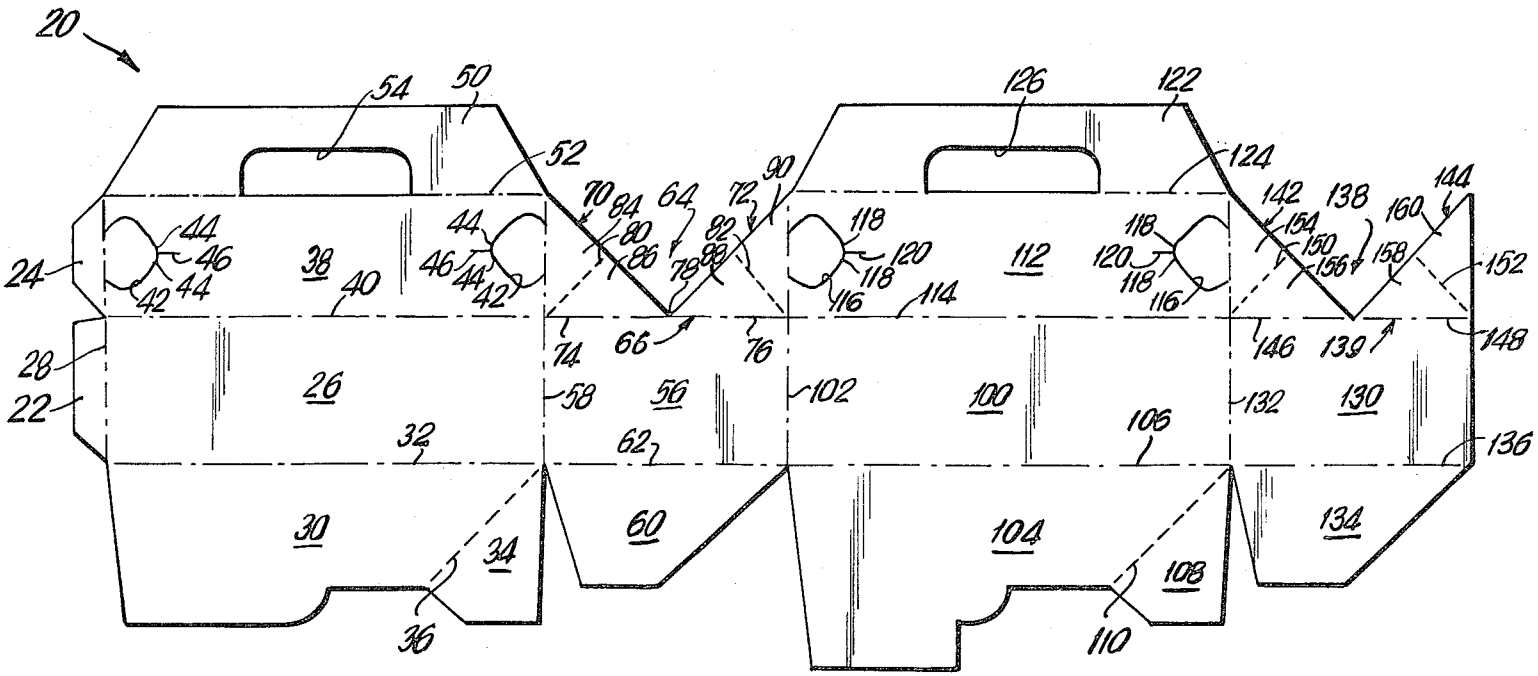
FIG. 1 is a plan view of the paperboard blank adapted to be folded into the take out carton of the subject invention.

Referring to FIG. 1, the blank 20 for forming the subject carton is illustrated and includes, starting from the left side of the Figure, a pair of glue flaps 22 and 24 which are connectable to the opposed end of the blank during the formation of the carton. A first side panel 26 is provided and is hingedly connected along fold line 28 to glue flap 22. A first major bottom panel 30 is hingedly connected to the bottom edge of first side panel 26 along fold line 32. The first major bottom panel 30 includes a first folding panel 34 defined by fold line 36. Preferably first folding panel is provided with an adhesive (not shown) to facilitate the erection of the carton. First major bottom panel 30 is one of four bottom panel segments which make up the components of a conventional auto-erecting lock bottom. The provision of an auto-erecting lock bottom enables the carton to be assembled by the manufacturer and shipped to the user in a flattened configuration where it can be quickly erected into the open configuration, as more fully described hereinafter.

A first top panel 38 is hingedly connected to the top edge of the first side panel 26 along fold line 40. In accordance with the subject invention, first top panel 38 is provided with a pair of tab receiving apertures 42 disposed at the opposed side edges of the panel. Each tab receiving aperture 42 includes a pair of bendable holding flaps 44 which is defined by nick or cut 46 formed in the top panel. The nicks 46 allow for the temporary enlargement of the tab receiving apertures 42 during the locking of the carton. The holding flaps 44 function to inhibit the inadvertent disengagement of a closure tab from the associated aperture, as more fully described hereinafter. A first handle panel 50 is hingedly connected to the top edge of first top panel 38 along fold line 52. First handle panel 50 includes the gripping aperture 54 to facilitate the carrying of the carton 10.

A first end panel 56 is hingedly connected to first side panel 26 along fold line 58, and a first minor bottom panel 60 is hingedly connected to the bottom edge of first end panel 56 along fold line 62. A first closure panel 64 is hingedly connected to the top edge of first end panel 56, along fold line 66, as well as to first top panel 38 along fold line 58. First closure panel 64 includes a pair of triangles 70, 72 along fold line portions 74 and 76, respectively of fold line 66. An apex of each of the triangles 70 and 72 meet at a common point 78 at the center of closure panel 64 on fold line 66. Each of the triangles 70 and 72 includes a central fold line 80, 82, respectively, which sub-divides each side triangle into opposed minor triangular portions 84, 86, 88 and 90. Each central fold line 80, 82 begins at the apex of the triangle adjacent the edge of first end panel 56 and extends to the opposite side of the triangle. Each central fold line 80 and 82 facilitates the bending of the associated side triangle into a two ply configuration to define a closure tab for interengagement with the tab receiveng apertures, as more fully described hereinafter.

A sceond side panel 100 is hingedly connected to first end panel 46 along fold line 102, while a second major bottom panel 104 is hingedly connected to the bottom edge of second side panel 100 along fold line 106. Second major bottom panel 104 includes a second folding panel 108 connected thereto along fold line 110 and is preferably provided with a contact adhesive (not shown). A second top panel 112 is hingedly connected to second side panel 100 along fold line 114, and is also hingedly connected to first closure panel 64 along fold line 102. Second top panel 112 is similarly provided with two tab receiving apertures 116 disposed on the opposed side edges thereof. Each tab receiving aperture 116 includes a pair of bendable holding flaps 118 defined by nicks 120. A second handle panel 122 is hingedly connected to the top edge of second top panel 112 along fold line 124 and includes an aperture 126 for gripping the carton 10.

A second end panel 130 is hingedly connected to the second side panel along fold line 132, and a second minor bottom panel 134 is hingedly connected to the bottom edge of second end panel 130 along fold line 136. Second closure panel 138 is hingedly connected to second end panel 130 along fold line 139, and is also connected to second top panel 112 along fold line 132. Second closure panel 138, similar to first closure panel 64 includes a pair of triangles 142 and 144, hingedly connected along fold line portion 146 and 148 of fold line 139. Each of the triangles 142, 144 includes a central fold line 150, 152, respectively, which subdivides each side triangle into minor triangular portions 154, 156, 158 and 160. The side and end panels may be straight or tapered from their top edges to their bottom edges to produce a carton having an inverted truncated pyramidal configuration which permits the stacked nesting of a plurality of cartons prior to their use.

Initially, bottom panels 30, 60, 104 and 134 are folded upwardly into abutting contact with the associated side or end panels. At the same time, panels 34 and 108 are folded back and adhesive applied to glue them to panels 60 and 134 respectively. Adhesive is then applied to glue flaps 22 and 24 onto the corresponding area on panels 130 and 160. Then panel 26 is folded at fold line 58 to rest on panel 56 and part of panel 100. Panel 130 is then folded at score line 132 to rest on part of panel 100 and over glue panels 22 and 24 to be adhered thereto.

Figure 3:
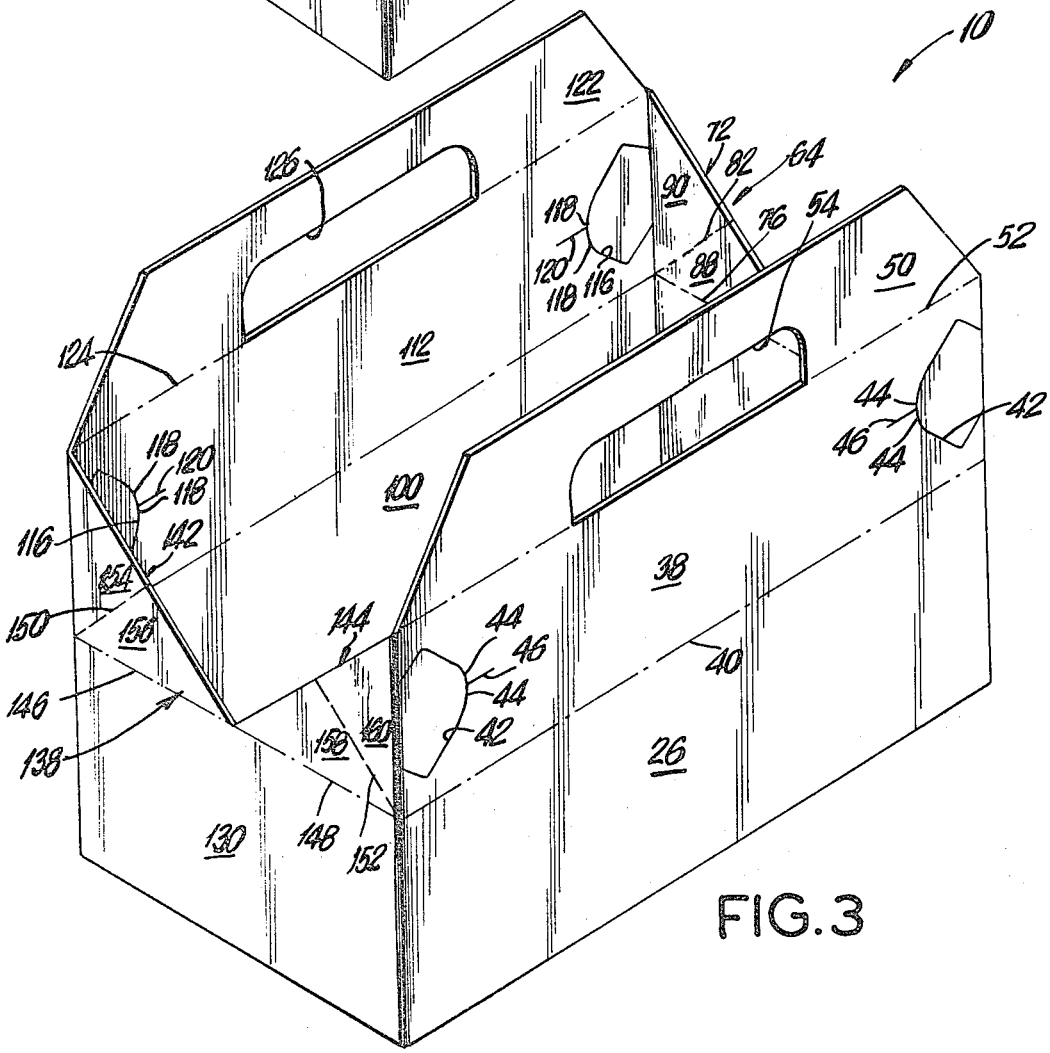
FIG. 3 is a perspective view of the new and improved carton of the subject invention illustrating the open configuration thereof.

The described folding and gluing steps produce a two dimensional structure which can be easily shipped from the manufacturer to the user. The carton is readily expanded to produce the open configuration (as illustrated in FIG. 3) by separating the side and end panels 26, 56, 100 and 130, to define the tubular side wall structure 12. As the side and end wall panels are separated the bottom panels 30, 60, 104 and 134 automatically interengage and drop into a horizontal orientation to produce a solid bottom panel 14. As noted above, the carton 10 may be provided with an inverted truncated pyramidal configuration. By this arrangement, the user may erect and stack a plurality of cartons thereby saving space. More specifically, after each succeeding carton is erected it may be inserted within the open top portion of the previously erected carton forming a stacked array.

Figure 4:
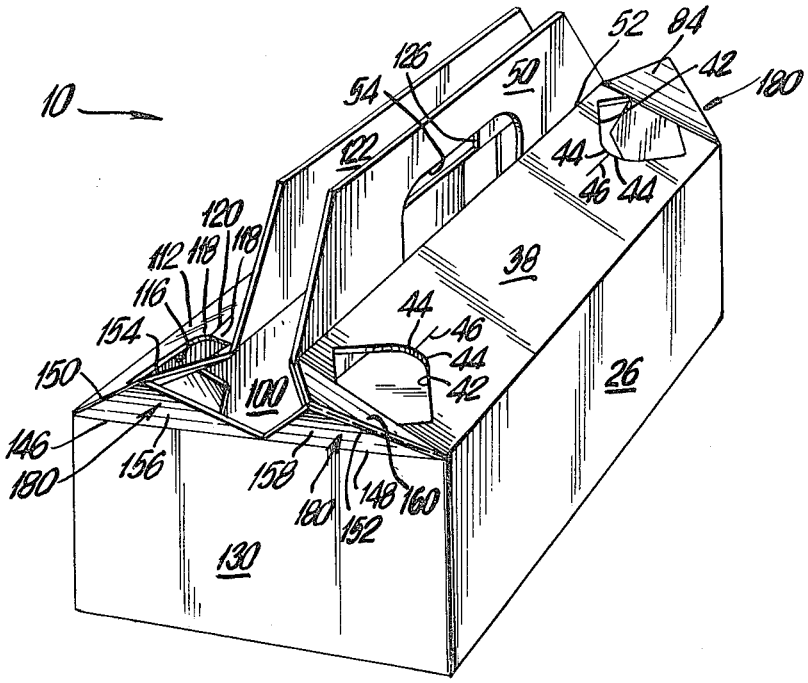
FIG. 4 is a perspective view of the take out carton of the subject invention illustrating the partial closing of the flat top portion.
Figure 5:
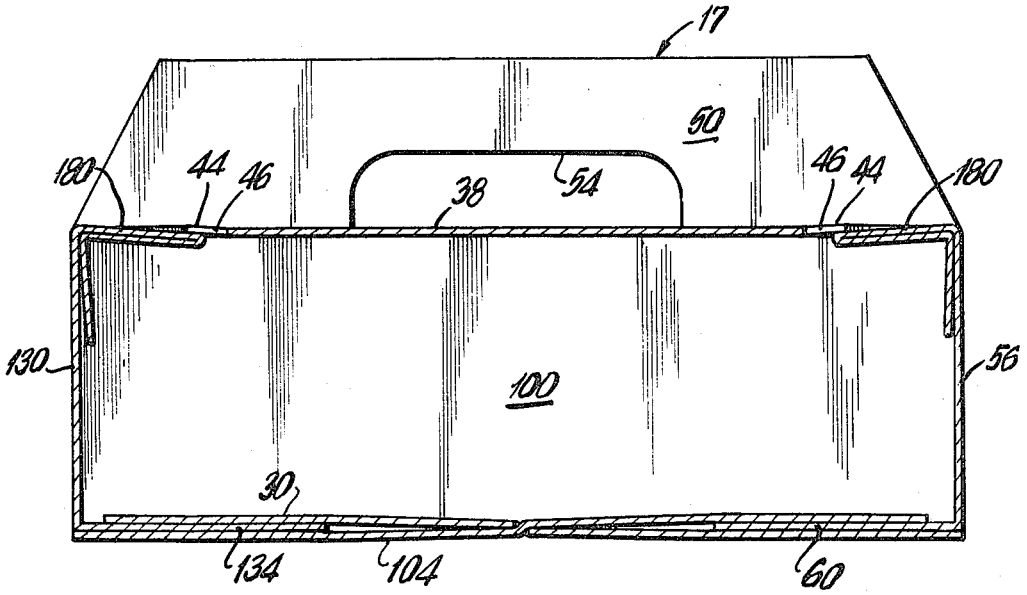
FIG. 5 is a cross-sectional view of the take out carton of the subject invention taken along the lines 5—5 of FIG. 2.

When a carton is needed for use, the uppermost carton may be removed from the stack and filled with the desired articles. Thereafter, and in accordance with the subject invention, the carton may be locked into the closed position enabling the carton to be readily carried. As illustrated in FIG. 4, to close the carton, top panels 38 and 112 are rotated such that the top edges thereof are disposed in abutting relationship, defining the flap top configuration 16. As the top panels 38, 112 are folded inwardly, each side triangle (70, 72, 142 and 144) of closure panels 64, 138 is folded about its central fold line (80, 82, 150 and 152, respectively) to form closure tabs 180. More specifically, the minor triangular portions of each side triangle are folded into abutting relationship to define a double-ply closure tab 180. Each closure tab 180 is then rotated into abutting relationship with the adjacent top panel 38, 112, with at least a portion thereof extending through and interengaged with a tab receiving aperture 42, 116. Preferably, the cross sectional area of each closure tab 180 is greater than the cross sectional area of the associated tab receiving aperture. As noted above, each tab receiving aperture is provided with bendable holding flaps 44, 118, defined by nicks 46, 120. As the closure tabs 180 are being interengaged, the nicks 46, 120 permit the temporary enlargement of the associated tab receiving aperture thereby facilitating the insertion of the tab into the interior of the carton. Thereafter, and as illustrated in FIG. 5, each holding flap 44, 118 functions to maintain the closure tab 180 in the interengaged position.

In the closed configuration of the take out carton 10 of the subject invention, as illustrated in FIG. 2, the top panels 38 and 112 are securely locked in the flat position. The opposed upstanding handle panels 40, 122 are aligned such that the apertures 54, 126 therein define a gripping means for the carton. The unique closure means of the subject carton functions to structurally rigidify the carton and inhibits the relative slidable movement between the side and handle panels. Closure tabs 180 can be readily manipulated and disengaged from the associated tab receiving apertures enabling the top panels to be separated, thereby opening the carton to permit access to its interior.

In summary, there is provided a new and improved take out carton having an auto-erecting bottom and a reclosable flat top portion. The carton includes an upstanding tubular side wall formed from opposed side and end panels. A pair of top panels are provided and are respectively hingedly connected to the top edges of the side panels. Each top panel is provided with a pair of opposed tab receiving apertures disposed adjacent the side edges thereof. A pair of closure panels are hingedly connected to the top edges of the opposed end panels and are formed from a pair of hingedly connected triangles. Each triangle is further divided by central fold line into minor triangular portions. The side and end panels may be straight or tapered from the top to the bottom edges thereof producing a carton having an inverted truncated pyramidal configuration. In the closed condition of the carton, the top edges of each top panel are in abutting relationship to form the flat top configuration. Each side triangle of the closure panels is folded to define a double-ply closure tab which is rotated into coplanar relationship with the top panels. A portion of each closure tab is interengaged with a tab receiving aperture of the top panel to secure the carton. The unique closure means of the subject invention provides increased stability for the carton and inhibits the relative slidable movement between the top panels.

The present invention has been described in the above specification with reference to a preferred embodiment and such reference is for purely illustrative purposes and various modifications in the details included therein may be made without departing from the scope or spirit of the invention as defined by the appended claims.

What is claimed is:

1. A take out carton having a reclosable flat top portion comprising:

a generally rectangular tubular side wall including alternatively hingedly connected opposed side panels and end panels;

a bottom panel hingedly connected to said side wall;

a pair of top panels, each respectively hingedly connected along the bottom edge thereof to the top edge of a side panel, each said top panel further including an opposed pair of tab receiving apertures, said tab receiving apertures being respectively disposed adjacent the opposed side edges of the associated top panel;

a handle hingedly connected to the top edge of each said top panel; and a pair of closure panels, each being formed from a pair of triangular sections with the bottom edge of each said triangle being respectively hingedly connected to the top edge of one of said end panels, and with one side edge of each said triangles being respectively hingedly connected to a side edge of a top panel, and with each said triangles further including a central fold line defining a pair of minor triangle portions, each said central fold line beginning at the apex of a triangle nearest to the edge of an associated end panel and extending to the opposite side of said triangle, whereby in the closed condition of the carton, the upper edges of said top panels are in abutting relationship forming a flat configuration, with said handles extending above said flat top portions, and with each said triangles of said closure panels being folded about said central fold line such that said minor triangle portions overlap to define a double thickness closure tab, of greater cross-sectional area than the cross-sectional area of the associated tab receiving aperture in said top panel, with each said closure tab being coplanar and interengaged with the associated top panel by having a portion thereof extending through said tab receiving aperture internally of said top panel therby structurally rigidifying said carton and maintaining said flat top portion in a closed position.

2. A take out carton as recited in claim 1 wherein each said side and end panels are tapered from the top edges to the bottom edges thereof such that the open configuration of said carton defines a generally inverted, truncated pyramidal configuration to enable the stacked nesting of a plurality of cartons.

3. A take out carton as recited in claim 2 wherein an apex of each said triangular section of each said closure panel is disposed at a common point at the center of said closure panel with said common point being disposed on said fold line hingedly connecting said closure panel to the top edge of one of said end panels.

4. A take out carton as recited in claim 1 wherein said triangles are equal in configuration.

5. A take out carton as recited in claim 1 further including a pair of bendable holding flaps associated with each said tab receiving aperture of said top panels, said bendable holding flaps being defined by nicks formed on said top panel, said bendable holding flaps for maintaining said closure tabs in an interengaged position.

6. A take out carton as recited in claim 1 wherein said bottom panel includes two major bottom panels and two minor bottom panels which are automatically interengaged during erection of said carton from a blank to form a closed bottom panel.

7. A taken out carton as recited in claim 1 wherein each said handle includes a gripping aperture, said gripping apertures in said handle being aligned to facilitate the carrying of said carton.

8. A paperboard blank adapted to be folded into a take out carton having a reclosable flat top portion comprising a first side panel;

a first major bottom panel hingedly connected to said first side panel;

a first top panel hingedly connected to said first side panel, said first top panel including a pair of opposed tab receiving apertures disposed adjacent the side edges thereof;

a first handle hingedly connected to said first top panel;

a first end panel hingedly connected to said first side panel;

a first minor bottom panel hingedly connected to said first end panel;

a first closure panel hingedly connected to said first end panel and said first top panel, said first closure panel including a pair of triangles with each said triangle further including a central fold line for defining a pair of minor triangle portions, each said fold line starting at the apex of a triangle adjacent said end panel edge and extending to the opposite side of said side triangle;

a second side panel hingedly connected to said first end panel;

a second major bottom panel hingedly connected to said second side panel;

a second to panel hingedly connected to said second side panel and said first closure panel, said second top panel including a pair of opposed tab receiving apertures disposed adjacent the side edges thereof;

a second handle hingedly connected to said second top panel;

a second end panel hingedly connected to said second side panel;

a second minor bottom panel hingedly connected to said second end panel; and a second closure panel hingedly connected to said second end panel and said second top panel, said second closure panel substantially corresponding to the configuration of said first closure panel.

9. A blank as recited in claim 8 wherein said side and end panels are tapered from the top edges to the bottom edges thereof.

10. A blank as recited in claim 8 further including a pair of bendable holding flaps associated with each said tab receiving aperture of said top panels, each pair of said holding flaps being defined by a nick formed in said top panel.

11. A blank as recited in claim 8 wherein each said handle includes a gripping opening.

12. A taken out carton having a reclosable flat top portion comprising:

a generally rectangular tubular side wall including alternatively hingedly connected opposed side panels and end panels;

a bottom panel hingedly connected to said side wall;

a pair of top panels, each respectively hingedly connected along the bottom edge thereof to the top edge of a side panel, each said top panel further including an opposed pair of tab receiving means, said tab receiving means being respectively disposed adjacent the opposed side edges of the associated top panel;

a handle hingedly connected to the top edge of each said top panel; and a pair of closure panels, each being formed from a pair of triangles with the bottom edge of each said triangles being respectively hingedly connected to the top edge of one of said end panels, and with one edge of each said triangles being respectively hingedly connected to a side edge of a top panel, and with each said triangles further including a central fold line defining a pair of minor triangle portions, each said central fold line beginning at the apex of a triangle nearest to the edge of an associated end panel and extending to the opposite side of said side triangle, whereby in the closed condition of the carton, the upper edges of said top panels are in abutting relationship forming a flat configuration, with said handles extending above said flat top portions, and with each said triangles of said closure panels being folded about said central fold line such that said minor triangle portions overlap to define a double thickness closure tab, with each said closure tab being coplanar and interengaged with the associated top panel by having a portion thereof extending through said tab receiving means internally of said top panel thereby structurally rigidifying said carton and maintaining said flap top portion in a closed position.

* * * * *